US005304041A

United States Patent [19]

Fontanazzi et al.

[11] Patent Number: 5,304,041

[45] Date of Patent: Apr. 19, 1994

[54] METHOD AND DEVICE FOR DOSING PUMPING

[75] Inventors: Paolo Fontanazzi, Modena; Alberto Fini, Carpi, both of Italy

[73] Assignee: Tetra Dev-Co, Modena, Italy

[21] Appl. No.: 933,084

[22] Filed: Aug. 21, 1992

[30] Foreign Application Priority Data

Aug. 27, 1991 [IT] Italy ..... MI 91 A 2291

[51] Int. Cl.[5] ..... F04B 13/00

[52] U.S. Cl. ..... 417/53; 417/517; 417/532

[58] Field of Search ..... 417/53, 517, 519, 532

[56] References Cited

U.S. PATENT DOCUMENTS

| | | | |
|---|---|---|---|
| 4,142,846 | 3/1979 | Yoshikawa | 417/517 |
| 4,358,257 | 11/1982 | Seiler et al. | 417/517 |
| 4,533,300 | 8/1985 | Westerlund et al. | 417/517 X |
| 5,024,584 | 6/1991 | Bordini et al. . | |
| 5,090,299 | 2/1992 | Santi et al. . | |

FOREIGN PATENT DOCUMENTS

| | | |
|---|---|---|
| 2342203 | 9/1977 | France . |
| 516084 | 11/1971 | Switzerland . |
| 617752 | 6/1980 | Switzerland . |

OTHER PUBLICATIONS

English-language translation of Swiss document 617 752 to *Blatter.*

*Primary Examiner*—Richard E. Gluck

*Attorney, Agent, or Firm*—Burns, Doane, Swecker & Mathis

[57] ABSTRACT

A method of pumping a product by means of a dosing pump unit entails that two individually driven pump chambers, which are connected with a common outlet, are controlled in such a way that the suction phases of the pump chambers overlap each other so that the total inflow to the pump unit is maintained constant. A pump unit includes two pump chambers which have a common inlet and outlet. Communication between the pump chambers and the inlet and outlet is controlled by a valve body, having an inlet passage that is formed such that it can be oriented to connect both pump chambers with the inlet.

14 Claims, 2 Drawing Sheets

METHOD AND DEVICE FOR DOSING PUMPING

FIELD OF THE INVENTION

The present invention relates to a method and apparatus for pumping and more particularly, to a method and apparatus for pumping in which flow is regulated between the chambers of a pump.

BACKGROUND OF THE INVENTION

The present invention concerns a method of pumping a pumpable product by means of a pump unit containing two pump chambers and a common control, which regulates the flow between the pump chambers and the unit's in- and out-flow.

With regular dispensing of a pumpable product by means of, e.g., a piston pump, an intermittent flow unavoidably arises in the pipe leading to the pump. This entails that pressure shocks arise in the pipe. With fast, regular dispensing of a product these pressure shocks can become very powerful and entail such serious damage to the pipe and its suspension that leakage arises.

Dosing pumps in the form of piston pumps are often used in industries such as the packaging industry. More particularly, piston pumps are often used in those filling machines which are used for filling bottles or packaging containers with liquid-state contents, e.g., various dairy products such as milk, sour milk and yogurt, or soups. Since packaging machines of this kind often work at high speed, pressure shocks in the pipe are a serious problem. The usual way of solving this is to provide the pipe with some form of pressure compensation device. In practice a tank is used or a level vessel in the form of a closed tank which is series-connected to the pipe and sometimes balanced with the aid of pressurized gas. The level in the tank is allowed to vary within certain limits and in this way pressure shocks between the pump and the tank can be compensated so that they do not spread any further to the pipe.

Even if the use of a compensation tank avoids the problem with pressure knocks, other problems are created instead, especially when the technique with a compensation tank is employed within the food industry, since the tank constitutes an irregularity in the pipe which thereby becomes difficult to wash in a satisfactory manner. With the type of packaging system that aseptically packages sterile foods, it is, in practice, impossible to wash and sterilize the tank in a rational manner, at least when several highly viscous products or products containing particles, e.g. soups, are to be packaged. A system with a compensation tank, which may also be provided with devices for being pressurized with inert gas, is, in addition, very expensive, particularly if it has to be made in a washable and sterilizable manner. With fast packaging machines, where a number of dosing pumps are used, the costs are increased.

OBJECTS AND SUMMARY OF THE INVENTION

An aim of the present invention is to provide a pumping method which avoids the above-mentioned problems and which is especially suited for use within the packaging industry, in particular for aseptic handling of viscous products.

Another aim of the present invention is therefore to provide a pumping method which makes it possible to compensate the delivery to a dosing pump so that harmful pressure shocks in the pipe are avoided.

A further aim of the present invention is to provide a pumping method which gives such an even delivery that further measures for pressure compensation in the incoming product flow can be avoided.

A further aim of the present invention is to provide a pumping method which is well suited for fast, accurate dosing in pumping of aseptic, slow-flowing foodstuffs in modern packaging machines.

These and other aims have been achieved according to the invention through the fact that a method of pumping a pumpable product by means of a pump unit containing two pump chambers and a common control, which regulates the flow between the pump chambers and the unit's in- and out-flow, is given the characteristic that the pump chambers' suction phases partly overlap each other, with the control simultaneously connecting the pump chambers with the inlet during a part of the pumping process.

An aim of the present invention is further to provide a pump unit which is well suited for being used in the realization of the above-mentioned method.

A further aim of the present invention is to provide a pump unit which, without causing pressure shocks in the pipe, makes possible fast and accurate volumetric dispensing of pumpable products of varying type and viscosity.

A further aim of the present invention is to provide a pump unit with a construction which gives high safety of operation and makes possible good cleaning and sterilizing.

These and other aims have been achieved according to the invention through the fact that the pump unit with two pump chambers which have common in- and out-flow and also a common control is given the characteristic that the control is a rotatable valve body with two passages.

BRIEF DESCRIPTION OF THE DRAWINGS

A preferred embodiment of both the method and the device according to the invention will now be described more closely with particular reference to the enclosed drawings, which only show the details essential for understanding the invention.

DETAILED DESCRIPTION OF THE PREFERRED EMBODIMENT

Figure 1:
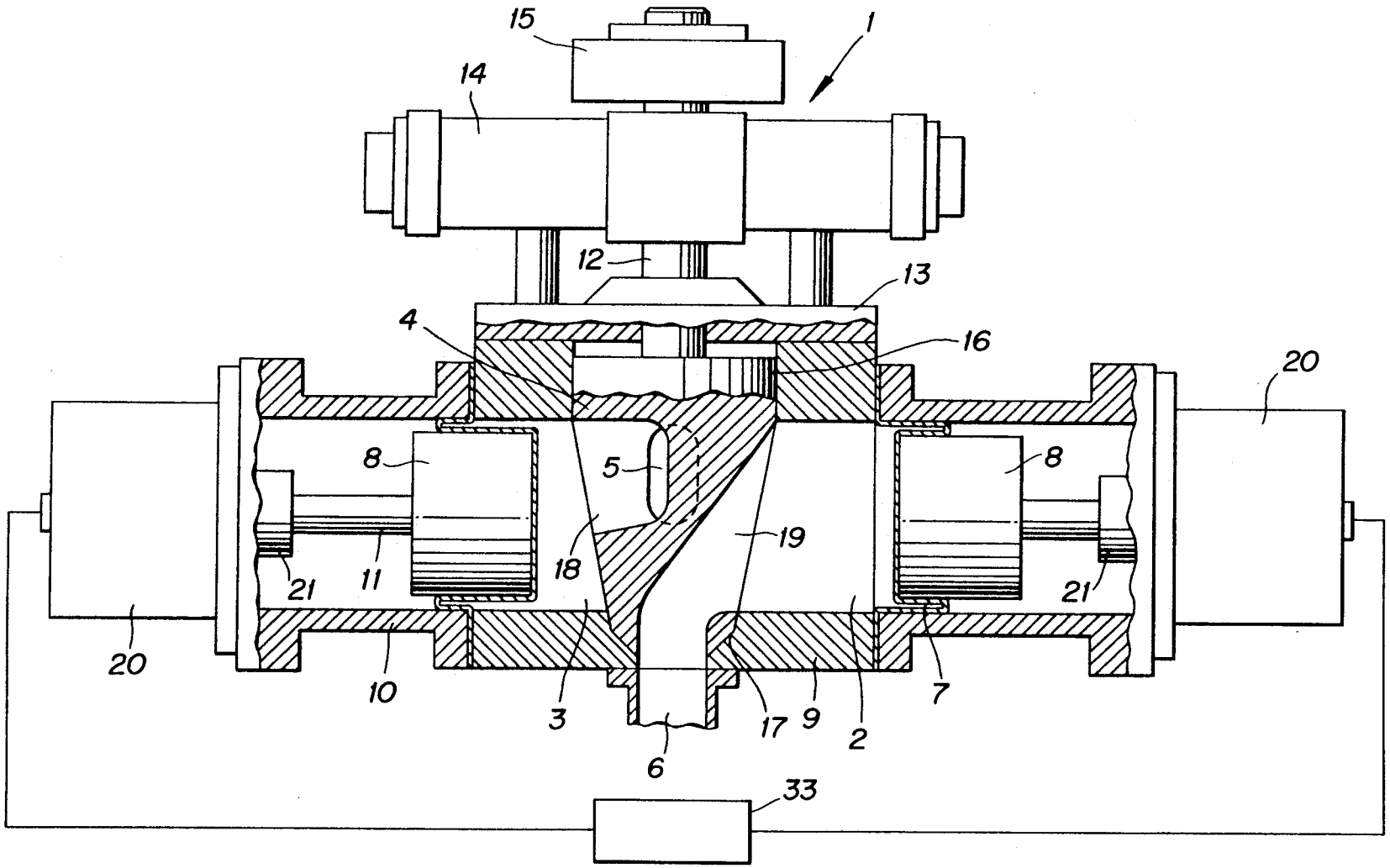
FIG. 1 is a schematic, partial cross-sectional side view of a pump united according to an embodiment of the present invention.

The preferred embodiments of a pump unit 1 according to the invention which is shown in FIG. 1 are intended to be used together with a packaging machine of the type which fills previously wholly or partly prepared, fillable packaging containers with the desired amount of contents. The contents, which can be of varying viscosity and which might contain particles, of, e.g., meat, are dispensed at even intervals in the form of volumetrically dosed portions into packaging containers, which are moved forward in time with the work of the pump unit.

The pump unit 1 shown in FIG. 1 has two pump chambers 2, 3, which are arranged in front of each other in a common plane. The pump chambers have between them a rotatable control 4 (in the form of a rotating body), which is arranged to connect the pump chambers 2, 3 with a sideways facing inlet 5 and a downward facing outlet 6. The pump unit, which is mainly made of stainless steel, further contains drive and control devices of types which are in themselves known.

Each one of the pump chambers 2, 3 situated in front of each other contains a backward and forward going wall in the form of a roller membrane 7, which bears against the front end of a pump piston 8. The pump chambers 2, 3 are cylindrical and situated partly in a valve housing 9, and partly in a pump housing 10. The pump housing 10 is so connected with the valve housing 9 that, in operation, the pump pistons 8 move backward and forward between a forward end position (as seen by the left piston shown in the pump chamber 3 in FIG. 1), in which the piston is partly inside the valve housing 9, and a rear end position (as seen by the right pump piston 8, which is in the pump chamber 2 in FIG. 1), in which the pump piston is in the part of the pump chamber 2 situated in the pump housing 10. The position of the end positions can be varied, which will be explained more closely below, and the flexibility and shape of the roller membrane 7 are therefore selected so that the piston movements are not hindered. The roller membrane 7, which is preferably manufactured from fabric-sheathed silicon rubber, is attached with its periphery between the valve housing 9 and the pump housing 10, which is screwed tight to the outside of the valve housing 9 by means of bolts not shown. The roller membrane 7 is also connected to the topside of the pump piston 8. In pump units intended for food and, in particular, such foods as are previously sterilized and must be packaged aseptically, it is appropriate to provide each pump piston 8 with double roller membranes, one of which is situated as shown on the front surface of the pump piston, the other being situated on the other side of the pump, i.e., the piston rod side. In order to ensure movement and to guarantee that contaminants cannot pass the membrane the space between these membranes is subjected to a vacuum in a manner in itself known, with the vacuum able to be constantly or periodically monitored so as to give indication immediately if membrane leakage occurs.

The pump piston 8 in each pump chamber 2, 3 is, like the pump chamber, mainly cylindrical and maneuverable backward and forward with the aid of a piston rod 11, whose opposite end is connected to a drive device, e.g., an individual controlled electric servo-motor 20, i.e., a type of permanent-magnet or brushless DC motor. The rotating movement of the servo-motor 20 is converted via a movement converter 21, e.g., a ball screw, to a linear movement acting on the piston rod 11. The servo-motor 20 is of the type well known to the technical person and, with the aid of electric regulators can be controlled so that it rotates in any desired direction and with any desired number of revolutions or parts of revolutions. In this way the movement of the pump piston 8 can be varied within wide limits as far as concerns its speed, stroke and selection of end position. Each pump piston 8 can in addition have a completely individual movement pattern, which can be controlled by a suitable data program.

As mentioned, the two pump housings 10 are situated on opposite sides of and linked with the valve housing 9 so that they are in front of each other, with the two pump pistons 8 moving not only in a common plane, but also along a common center axis. Between the two pump housings 10 there is on this center axis the control 4, which has the form of a rotatable, truncated conical valve body, whose axis of rotation is vertical and crosses the common center axis of the pump pistons 8 at right angles. The control or valve body 4 is maneuverable by means of a valve shaft 12, which extends vertically upward through a top wall 13 of the valve housing 9. The upper end of the valve shaft 12 is to the desired extent turnable or rotatable with the aid of a control motor 14, and also axially displaceable by means of a lifting motor 15. The control motor 14 can be of an electric or pneumatic type and act on the valve shaft 12, e.g., via a worm gear arrangement or rack and pinion, while the lifting motor 15 is preferably a pneumatic ram and cylinder unit, whose stroke only amounts to about 10–20 mm.

The valve body 4 is provided at its upper end with a cylindrical bearing surface 16, by means of which the valve body bears against the corresponding cylindrical bearing surface in the upper part of the valve housing 9, through which the turning or rotating movement of the valve body 4 is stabilized and transverse movements are avoided. The lower end of the valve body 4 exhibits a conical sealing surface 17, which bears against a corresponding conical surface in the lower end of the valve housing 9. The valve body 4 can be made of stainless steel which, in order to give the unit the desired length of life, is exposed to some suitable hardening surface treatment or possibly partly replaced by hard ceramic low-friction material. Various suitable types of material are well known to those of ordinary skill in the art and can be selected depending on the desired life, pumped product, etc.

As an alternative to the described bearing surfaces of the valve body 4 and the valve housing 9 it is also possible to keep the valve body 4 in a correct radial position by means of bearings (not shown) on the upper part of the valve shaft 12. With this construction the wear on the valve surfaces can be minimized. It also becomes possible to adjust the radial play between the valve body 4 and the valve housing 9 by simply adjusting the axial position of the valve body 4. A screw-device for such axial adjustment can be fitted at the upper end of the valve shaft 12. Such a device is however known in itself and therefore not illustrated here.

The radially arranged inlet 5 of the valve housing 9 extends through the wall of the valve housing 9 as far as the conical cut-out where the valve body 4 is situated. At the corresponding height the vertically mounted valve body 4 exhibits an inlet passage 18, which has the form of a horizontal (transverse) mainly U-shaped slot extending through an upper part of the valve body 4 and situated with its upper part at the same height as or higher than the upper part of the pump cylinder, which guarantees that any gas that may be found in the cylinder can flow out freely so that internal air pockets are avoided. The slot's ends come out at diametrically opposite sides of the valve body. This is illustrated more clearly in FIG. 2, where it can be seen how the inlet passage 18 encloses an angle of more than 180° of the peripheral surface of the valve body 4. Through the placing of the inlet passage 18 mainly in the upper part of the conical valve body 4 there is space in the lower part of the valve body for an outlet passage 19, one end of which has the form of an oval, vertically extending orifice, whose height mainly accords with the diameter of the pump chamber 2 and therewith in the vertical plane occupies the whole free surface of the conical part of the valve body 4 turned toward the pump chamber 2. Since the orifice extends downward to or below the bottom part of the pump cylinder the pump is, when it is angled in the intended manner, i.e., with the pump cylinders horizontal, completely self-draining, which like the previously mentioned freedom from air pockets is of great importance from the standpoint both of hygiene and accuracy. The outlet passage extends from the aforesaid opening mainly 45° downward toward the lower end of the valve body 4, where it goes over into the mainly vertically (axially) extending cylindrical outlet 6. The outlet 6 is connected to the packaging machine's filler pipe, i.e., the pipe via which the pumped product is taken to the packaging container which, in the particular instance, is to be filled. In a corresponding manner, in itself well known, the inlet 5 is connected via pipes (not shown) to a container or the like, in which the product which is to be packaged is contained.

As mentioned previously both the two servo-motors 20 and the control motor 14 are connected with control and regulation devices 30 of known type, which see to it that the movement pattern of the various parts and the times for their movements accord with a prearranged scheme, such as might be contained in a computer program. In order to control the movements and possibly use a feedback facility both the pump pistons 8 and the valve body 4 can of course work in conjunction with suitable position sensors, but this also is, for one of ordinary skill, a known technology which does not need to be described more closely in this connection.

When the pump unit according to the invention is used with a packaging machine of known type it is placed so that the outlet 6 is given a natural continuation in a downward extending filler pipe which is not shown, from which the product is dispensed into the packaging containers. If the pump unit is placed with the two pump chambers 2, 3 disposed horizontally and with the center axis of the valve body 4 disposed vertically the pump is self-draining, which is of great importance both in pumping and in cleaning of the same. The pump's inlet 5 is connected to a contents tank or the like, which is conveniently situated at a slightly higher level than the pump unit itself. In larger installations it often happens that a number of packaging machines are fed with contents or product which is to be packaged from a common main pipe, and the inlet 5 from each pump unit is in the case of course connected to the aforesaid main pipe. Thanks to the fact that the pump unit according to the invention, in spite of the piston pumps' volumetric dosing dispensing, provides a non-varying, even flow in the inlet 5 the pump unit can be connected directly to the main pipe without any form of pressure compensating device, e.g., a level tank, needing to be used. Through this, the washing of the equipment is considerably simplified, at the same time as it becomes possible to use the arrangement for previously sterilized products, since one can ensure through a simple steam sterilization that all parts of the equipment's surfaces coming into contact with the contents are completely sterile.

Figure 3A:
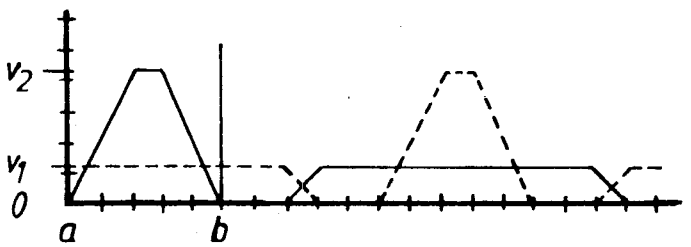
FIGS. 3A, 3B and 3C illustrate in diagram form the pumping method according to an embodiment of the present invention.
Figure 3B:
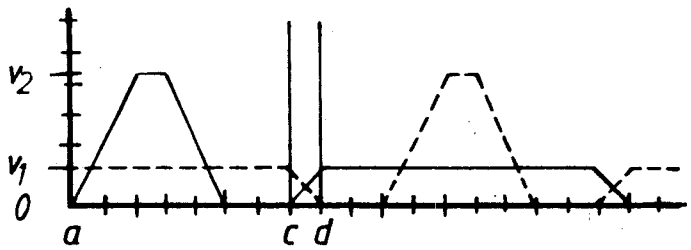
Figure 3C:
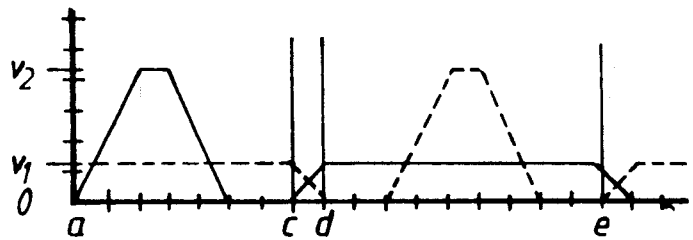
Figure 2A:
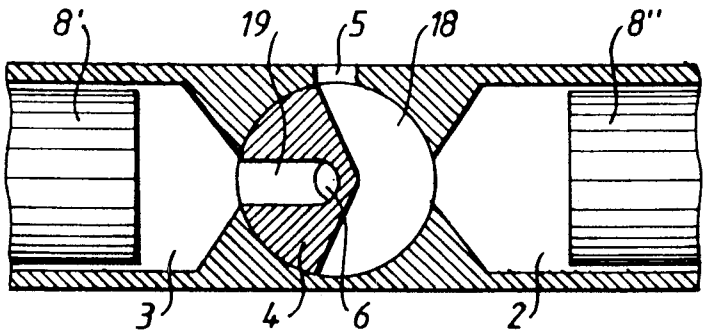
FIGS. 2A, 2B and 2C are schematic views of a pump unit according to an embodiment of the present invention in different working positions.
Figure 2B:
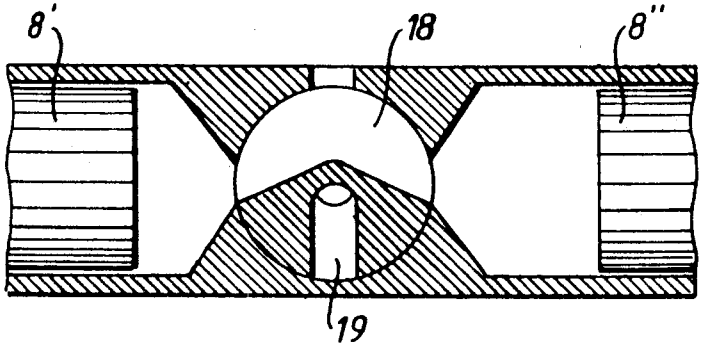
Figure 2C:
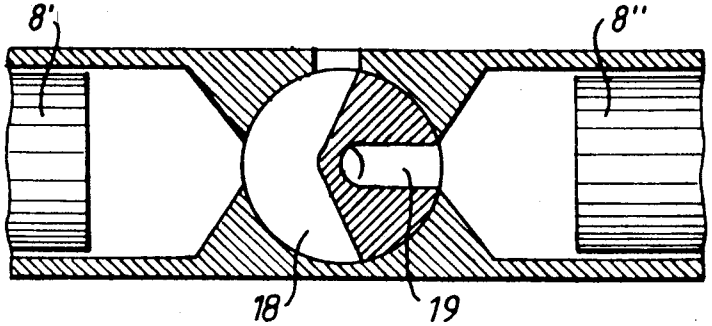

The manner of pumping a pumpable product in volumetric portions, with operation of the pump unit according to the invention, is illustrated schematically in FIGS. 2A, 2B and 2C where both the movements of the two pump pistons 8 and the different positions of the control or valve body 4 are shown. In FIGS. 3A, 3B and 3C the movements of the two pump pistons 8 are schematically shown in the corresponding manner and therewith the flow in the inlet 5 or outlet 6 as a function of time. The movement of the piston 8' shown on the left in FIGS. 2A, 2B and 2C is illustrated by full lines in FIGS. 3A, 3B and 3C while dotted lines show the movements of the piston 8'' which is on the right in FIGS. 2A, 2B and 2C. It should be observed that the FIGS. 2A, 2B, 2C, 3A, 3B and 3C, only illustrate alternative modes of preferred operation, which of course can be varied, since both the two pump pistons 8 and the valve body 4 are driven individually by separate motors and in accordance with a prearranged program. For example, the rate of flow in the outlet can be varied within wide limits so as to be adapted to the type of contents which are to be filled, the time which is available, or other parameters. This is possible without the invention's essential characteristic features being affected, i.e., that the suction phases of the pump chambers partly overlap each other, with the control simultaneously connecting the pump chambers to the inlet for part of the pumping process so that the resulting flow in the inlet 5 remains constant.

In the step-by-step illustration of the pumping process according to the invention which is illustrated in the FIGS. 2A, 2B, and 2C it is shown in FIG. 2A how the left pump piston 8' executes a working stroke, i.e., moves from left to right so that contents which are in the accompanying pump chamber 2 are taken via the outlet passage 19 in the valve body 4 to the outlet from the outlet 6. From the outlet 6, the contents pass onto the filler pipe in the packaging machine (not shown). With the valve body 4 in the position shown in FIG. 2A, the left pump chamber 2 is thus connected via the outlet passage 19 to the outlet 6, while the right pump chamber is given a connection via the inlet passage 18 to the inlet 5. The inlet 5 is connected in the manner previously described to a feed pipe (not shown) for feeding the contents. The pump piston 8'' shown on the right in FIG. 2A is moved in a return stroke, with which the contents are sucked from the feed pipe via the inlet 5 and the inlet passage 18 in the valve body 4 so that the pump chamber 2 belonging to the pump piston 8'' is filled with contents. The process shown schematically in FIG. 2A is illustrated in FIG. 3A, with the portion of the process taking place between the points a and b on the diagram's horizontal time axis. From the full line curve illustrating the movement of the pump piston 8' it can be seen how the pump piston accelerates from its rear end position (point a in the diagram) to a constant speed ($V_2$), after which the speed of the pump piston 8' again decreases so that it is again zero at the pump piston's forward end position (b in the diagram). In the corresponding time the other piston 8'' has a lower, constant movement ($V_1$) from its forward end position to its rear one, and this movement also continues after moment b.

FIG. 2B shows the pump unit according to the invention at the movement when the control motor 14 has turned the valve body 4 via the valve axle 12 half-way from the position shown in FIG. 2A to the position shown in FIG. 2C. The pump piston 8' has left its forward end position and begun its return stroke, at the same time as the pump piston 8'' has not yet fully concluded the return stroke begun in FIG. 2A. In FIG. 3B the full line illustrates how, between the moments c and d, the pump piston 8' is accelerated from its forward end position, in which it was situated after the conclusion of the previous pump stroke, to a constant speed with which the return stroke is effected. The return stroke of the pump piston 8" in progress is broken off at the same time at moment c, and the movement of the pump piston 8" comes successively to a standstill so as to have ceased completely at moment d. Between the two moments c and d, the suction movements of the two pistons 8' and 8" complement each other so that the total change of volume in the two pump chambers is as great as the change of volume in a single chamber during the attendant suction stroke of the pump piston. Since the valve body 4 between the moments c and d connects pump chamber 2 of the two pump pistons with the inlet 5, it is by this means ensured that the rate of flow in the inlet 5 and the accompanying pipe system remains constant in spite of the pump unit's portion-wise dispensing of contents via the outlet 6.

In FIG. 2C the left pump piston 8' continues its suction stroke, while the opposing pump piston 8" leaves its rear end position and begins its pump stroke. The valve body 4 has been turned to its opposite end position in relation to FIG. 2A, wherewith it connects the left pump chamber to the inlet 5 at the same time as the right pump chamber discharges into the outlet 6. In the accompanying diagram (FIG. 3C) this process is illustrated between moments d and e, wherewith it can be seen how the curve belonging to the pump piston 8' represents a straight line, i.e., the pump piston 8' has the aforesaid constant return speed ($V_1$) which gives a constant flow of product in the inlet 5. The dotted curve which illustrates the movement of the pump piston 8" shows how this pump piston, after its stationary period in the rear end position, is accelerated to the speed ($V_2$) and thereafter retarded so that, when it reaches its forward end position, it again has zero speed, after which a new pump cycle is begun.

A precondition for the overlapping suction phases of the two pump chambers 2, 3 to result in an even flow in the inlet 5 is, of course, that the control or valve body 4 is so shaped and maneuvered that the connection between the two pump chambers and the inlet 5 is simultaneously maintained for a certain time. With the type of valve body 4 which is shown this can happen either through the valve body 4 as described being maneuvered principally at constant speed between the two end positions (FIG. 2A, and FIG. 2C respectively), or also through the valve body 4 being maneuvered step-by-step between three positions, mainly the two positions in FIG. 2A and FIG. 2C respectively and also an intermediate position, which corresponds to the position shown in FIG. 2B, i.e., the position in which the connection between the two pump chambers 2, 3 and the inlet 5 is open to the maximum. Through suitable adaptation of the movement of the pump pistons 8', 8", an even suction process in the inlet 5 is be obtained in this manner. This step-by-step rotation of the valve body 4 offers the advantage that the flow path from the inlet 5 is open to the maximum for a certain time, which in pumping of contents which contain solid particles, e.g., bits of meat, berries or the like, can be an advantage since it makes possible pumping of particles with maximum size. A continuous rotating movement, however, gives a smoother work process, which should normally be preferred in pumping of a number of products which do not contain large solid particles.

The fact that the suction phases of the two pump chambers overlap each other also gives an extended suction time, which reduces the necessary flow rate in the inlet 5 and thereby results in a more certain and better filling of the pump chamber, which is a great advantage especially in pumping of highly viscous products with particles.

The individual drive of the two pump pistons 8 and the selection of suitable end positions makes it possible to vary the pump volume during operation, which can be used in order to adapt the pump volume and thereby the degree of filling in the packaging containers after a weight check of the previously filled packaging containers has been made.

The pump unit according to the invention should as previously mentioned, be mounted with the common center axis of the two pump chambers in a horizontal position and with the axis of rotation of the valve body in a vertical position, since this facilitates the emptying of the pump unit, e.g., when it has to be washed. The washing is done in a conventional manner, i.e., through the pump unit being able to pump a suitable cleaning fluid, e.g., lye. In addition to the normal pump movement the individual control of the two servo-motors 20 allows varying piston movements and varying end positions to be able to be selected, which gives a particularly effective cleaning of the roller membrane and the inside of the pump chambers. With the aid of the lifting motor 15 the valve body 4 can be lifted out of its position during the washing process so that the washing fluid can pass also between the sealing surface 17 of the valve body 4 situated at the bottom of it and the valve housing 9 and also between the other surfaces of the valve body 4 and the valve housing 9 normally bearing against each other. The individual control of the servo-motors 20 can be used so as to give the two pump pistons 8 an opposing phase movement, through which the cleaning fluid's rate of flow can be varied within wide limits so that an effective and sure cleaning of the inside of the pump unit can be guaranteed. After the conclusion of the cleaning the cleaning fluid can, owing to the pump's self-draining shape, run out via outlet 6, after which the valve body 4 is again lowered to its working position and the pump unit is set for normal operation. If necessary a sterilization with steam or any other sterilization medium, e.g., hydrogen peroxide in vapor or gas form, can be undertaken after the washing process itself.

The pumping method and pump unit according to the invention thus make it possible, in spite of volumetrically dosed pumping, to provide a constant product flow in the pump's feed pipe, so that pressure shocks are avoided. By this means the need for pressure compensation devices is also eliminated, which makes possible an accurate washing and sterilization of the whole product channel from the product tank to the packaging machine's filler pipes discharging into the packaging containers.

While this invention has been illustrated and described in accordance with a preferred embodiment, it is recognized that variations and changes may be made therein without departing from the invention as set forth in the claims.

What is claimed is:

1. A method of pumping a product with a pump unit having a first and a second chamber and a first and a second reciprocating piston movable in the respective first and second chambers, the first and second chambers alternatingly communicating with inlet and outlet passages, comprising the steps of:

displacing the first piston in the first chamber through a first piston suction stroke;

displacing the second piston in the second chamber through a second piston suction stroke;

controlling the timing of the first and second piston suction strokes so that least an initial portion of the second piston suction stroke and at least a final portion of the first piston suction stroke occur at the same time;

opening the inlet passage such that, while the first piston is displaced through the final portion of the first piston suction stroke and while the second piston is displaced through the initial portion of the second piston suction stroke, the inlet passage is fully open to both the first and second chambers.

2. The method according to claim 1, wherein the inlet and outlet passages are formed in a rotatable control valve and comprising the further steps of:

continuously orienting the control valve to alternately open and close the inlet passage to the first and second chambers;

decelerating the first piston as it is displaced through the final portion of the first piston suction stroke; and accelerating the second piston as it is displaced through the initial portion of the second piston suction stroke, the first piston being decelerated and the second piston being accelerated such that, as the first piston is displaced through the final portion of the first piston suction stroke and the second piston is displaced through the initial portion of the second piston suction stroke, inflow to the first chamber from the inlet passage is reduced as inflow to the second chamber is increased in a corresponding manner to maintain a constant total inflow to the pump unit.

3. The method according to claim 18, wherein the inlet and outlet passages are formed in a rotatable control valve, comprising the further steps of:

orienting the control valve in a first end position in which the inlet passage communicates with the first chamber; and subsequently orienting the control valve in a second end position in which the inlet passage communicates with the second chamber, wherein the inlet passage is open such that the inlet passage is fully open to both the first and second chambers when the control valve is in an intermediate position between the first and second end positions, and wherein the control valve is oriented in one of the first and second end positions by rotating the control valve.

4. The method according to claim 1, wherein the inlet and outlet passages are formed in a rotatable control valve, and comprising the further step of subsequently orienting the control valve such that the outlet passage communicates with the first chamber.

5. The method according to claim 4, comprising the further step of beginning a first piston working stroke after communication between the outlet passage and the first chamber is fully opened.

6. A method of pumping a product with a pump including a first chamber and a second chamber and first and second pistons movable in the first and second chamber, respectively, the pump further including valve means including an inlet passage and an outlet passage, the inlet passage and the outlet passage being adapted to communicate with the first and second chambers, the method comprising the steps of:

orienting the valve means in a first position such that the inlet passage communicates only with the first chamber and the outlet passage communicates only with the second chamber;

moving the first piston through at least a portion of a first piston suction stroke;

moving the second piston through a working stroke;

orienting the valve means in a second position such that, at a final portion of the first suction stroke and during an initial portion of a second piston suction stroke, the inlet passage is fully open to both the first and second chambers;

subsequently closing communication between the inlet passage and the first chamber.

7. The method according to claim 6, comprising the further step of opening communication between the outlet passage and the first chamber as communication between the inlet passage and the first chamber is closed.

8. The method according to claim 7, comprising the further step of moving the first piston through an initial portion of a working stroke as communication between the outlet passage and the first chamber is opened.

9. The method according to claim 6, comprising the further step of orienting the valve means in a second position such that, at a final portion of the second piston suction stroke and during an initial portion of a subsequent first piston suction stroke, the inlet passage is fully open to both the first and second chambers.

10. The method according to claim 9, wherein the valve means is reoriented by being rotated, in a back-and-forth fashion, through 180°.

11. The method according to claim 6, wherein, when the valve means is oriented such that the inlet passage is fully open to both the first and second chambers, the outlet passage is open to neither the first nor the second chamber.

12. The method according to claim 11, comprising the further step of opening communication between the first chamber and the outlet passage after communication between the first chamber and the inlet passage is fully closed.

13. The method according to claim 12, comprising the further steps of beginning the first piston working stroke after beginning the second piston suction stroke and ending the first piston working stroke before ending the second piston suction stroke.

14. The method according to claim 12, wherein the first piston working stroke begins after communication with the first chamber and the outlet passage is fully opened.

* * * * *